United States Patent [19]

Lowery

[11] 3,996,754

[45] Dec. 14, 1976

[54] MOBILE MARINE DRILLING UNIT

[75] Inventor: Edwin L. Lowery, Houston, Tex.

[73] Assignee: Engineering Technology Analysts, Inc., Houston, Tex.

[22] Filed: Dec. 14, 1973

[21] Appl. No.: 424,838

[52] U.S. Cl. ..... 61/92; 175/7; 61/101

[51] Int. Cl.[2] ..... E02B 17/00

[58] Field of Search ..... 61/46.5, 46; 175/7, 175/9; 114/.5 D

[56] References Cited

UNITED STATES PATENTS

| | | | |
|---|---|---|---|
| 2,248,051 | 7/1941 | Armstrong | 61/46.5 |
| 3,244,242 | 4/1966 | Wolff | 61/46.5 |
| 3,433,024 | 3/1969 | Diamond et al. | 61/46.5 |
| 3,456,447 | 7/1969 | MacKintosh | 61/46.5 |
| 3,474,749 | 10/1969 | Williamson | 61/46.5 X |
| 3,793,840 | 2/1974 | Mott | 61/46.5 |
| 3,898,847 | 8/1975 | Magnanini | 61/46.5 |

FOREIGN PATENTS OR APPLICATIONS

| | | | |
|---|---|---|---|
| 991,247 | 5/1965 | United Kingdom | 61/46.5 |

OTHER PUBLICATIONS

Ocean Industry of Mar. 1973, p. 30.
World Oil of Nov. 1973, pp. 90–92.

*Primary Examiner*—Jacob Shapiro
*Attorney, Agent, or Firm*—Bill B. Berryhill

[57] ABSTRACT

A mobile marine drilling unit comprising: a floatable base; a floatable platform; and a vertical support leg attached to said base and extending upwardly through a well provided therefor in said platform. Said base and a major portion of said leg being submergible in a body of water for support on the floor thereof. The support leg and platform are provided with elevating mechanisms for elevating the platform above said body of water on said leg. In deploying the drilling unit, the unit is floated to a selected site with the base drawn up underneath the platform and the leg extending upwardly through the well. When the site is reached the base is submerged with ballast until it is supported on the water body floor. Then the platform is elevated above the water body by the elevating mechanisms. A derrick may be moved over the leg well and drilling in the water body floor conducted through the well and leg.

5 Claims, 6 Drawing Figures

MOBILE MARINE DRILLING UNIT

BACKGROUND OF THE INVENTION

1. Field of the Invention

The present invention pertains to apparatus and methods for drilling oil and or gas wells. More specifically, the present invention pertains to such a drilling unit and method suitable for drilling underwater wells.

2. Description of the Prior Art

There are several different types of rigs by which marine drilling is conducted. Of course one of the first developed was the fixed platform rig in which the legs or supports of the rig are permanently installed, penetrating the floor of the body of water in which the well is to be drilled. Such a rig is limited by water depth and does not provide the mobility and flexibility of the mobile or portable type drilling rig.

A later development was the submersible rig which is provided with a floating hull. This type of rig can be floated to a drilling site where the hull is filled with water ballast causing the hull to gradually sink until safety stabilized on the water body floor. After drilling is completed, the water ballast can be removed and the hull floated to the surface. This type of drilling rig is also limited by water depth. A recent example of a submersible type drilling rig is the one shown in U.S. Pat. No. 3,241,324. In an effort to overcome water depth limitations, various rigs have been developed which offer an extended height. See for example U.S. Pat. No. 2,938,354. To extend the height of this unit it is necessary to build it up by surmounting building block sections, one on top of the other.

In still later developments, drilling has been conducted from floating hull rigs. Although floating hull rigs are highly mobile, they are easily influenced by waves, winds, and other weather conditions, creating stability problems. Some of these problems have been alleviated by the development of "semi-submersible" rigs which derive their buoyancy from vertical columns or tanks, rather than from a conventional ship hull. Such a vessel is floated to a drilling site and partially submerged by flooding. The vertical columns or tanks have a relatively small exposed area at the waterline and consequently such a unit has a longer natural period in heave than does a hull type rig. The semi-submersible platform is, therefore, relatively less excited by waves and is usually quite stable in heave, pitch and roll.

A further development was the self-elevating platform, sometimes called "bootstrap" or "jack-up", rig in which a plurality of legs, usually three, are lowered from a floating platform into the water for penetration of the water body floor. The platform is then elevated on the legs a sufficient distance above the water surface. Although such rigs are highly mobile and stable when in place, they tend to be unstable when floating and when in transit from site to site and are limited by water depth. In areas of extreme weather conditions, the three or more legs of such rigs may have severe structural problems.

Although the different types of drilling units offer certain advantages, no one is completely suitable for every offshore drilling condition encountered. In an effort to incorporate some of the advantages of these units, various hybrid units have been developed which combine features of two or more of the basic type of drilling units. For example U.S. Pat. No 3,381,482 discloses a unit which combines the features of both submersible and semi-submersible type units. This unit has a submergible bottom supported lower portion and a semi-submersible upper portion which is extensible by ballast means.

U.S. Pat. No. 3,062,014 discloses a submersible type unit which is provided with a telescoping mast. After the entire unit is submerged for support on the floor of the body of water, the mast is extended upwardly to a desired position above the surface of the body of water. U.S. Pat. No. 3,456,447 discloses a drilling unit comprising a floatable tower and platform. The tower is floated to a selected site and submerged for support on the water body floor. Then the platform is floated around a portion of the tower extending above the surface of the water and raised to an elevated position thereon.

SUMMARY OF THE PRESENT INVENTION

The drilling rig of the present invention combines desirable features of submersible, semi-submersible, and jack-up rigs. The rig is made up of three major components: a floatable base, a floatable platform, and a single support leg which is attached to the base and extends upwardly through a well provided therefor in the platform. The platform supports a drilling derrick, living quarters and other equipment necessary for drilling.

The base, similar to a semi-submersible rig, is provided with vertical columns which provide buyoancy for supporting the rig while it is floating and is in transit from site to site. Should it be desired to increase the stability of the rig during transit, say for heavy seas, the columns may be partially filled with water and lowered to a partially submerged position, lowering the center of gravity of the rig and increasing its stability.

Upon reaching the selected drilling site, the base may be fully submerged until it and the support leg are fully supported on the floor of the body of water. At this point, the platform which is now floating on the surface of the body of water may be elevated, by means of elevating mechanisms, to a selected height above the surface of the body of water. A derrick is mounted on the platform for lateral movement from a position to the side of the leg to a position above the leg and leg well from which drilling may be conducted through the well and the leg. The elevating mechanisms may be removed and the platform permanently fixed on the leg so that the rig becomes a permanent production platform.

During drilling, only a single leg extends upwardly through the water, reducing the cross sections subjected to wave forces and currents so that these forces are reduced to a minimum. The drilling rig of the present invention offers the advantages of submersible, semi-submersible and jack-up rigs without some of the disadvantages inherent in each of these designs. Further objects and advantages of the invention will become apparent from the description which follows in conjunction with the accompanying drawings.

DESCRIPTION OF THE PREFERRED EMBODIMENT

Figure 1:
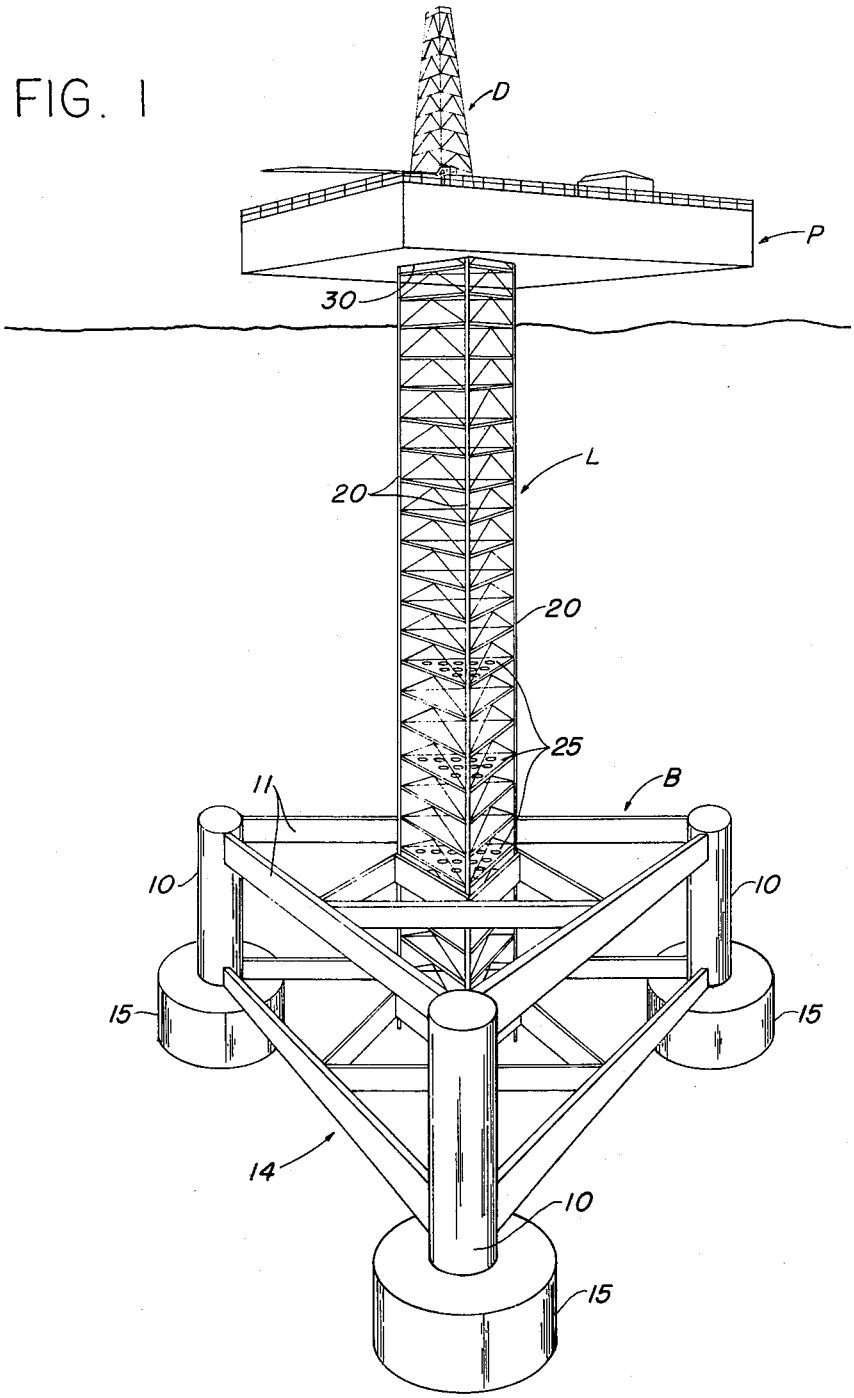
FIG. 1 is a perspective view of a drilling unit, according to a preferred embodiment of the invention, shown on site with its base submerged and its platform elevated for drilling.
Figure 2:
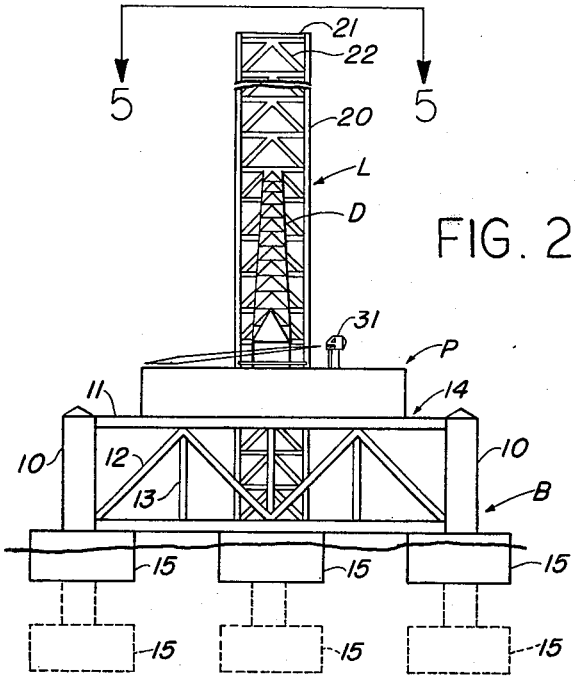
FIGS. 2–4 are elevational drawings, illustrating floating, semi-submerged, submerging, and operational positions, respectively, of the drilling unit of the present invention.

Referring first to FIGS. 1–4, the drilling unit of the present invention comprises three major components; base B, platform P and support leg L. The base B may comprise a plurality of vertical columns or columnar tanks 10 rigidly connected by interconnecting structural members 11, 12, 13 etc. forming a triangular square, or other shaped frame 14. The base may also comprise a plurality of cylindrical tanks 15, attached beneath each of the columnar tanks 10. Both the columnar tanks 10 and cylindrical tanks 15 may be provided with means for pumping ballast fluids into or out of such tanks. As will be more fully understood hereafter, these tanks 10 and 15 may also provide storage for drilling and production fluids. The tanks 10 and 15 are of such a size that when a sufficient amount of ballast fluids are removed therefrom, the entire drilling unit may be supported on the base B during transit from site to site, as shown in FIG. 2. Thus, the base unit if floatable and may provide support to the platform P and the leg L.

Figure 5:
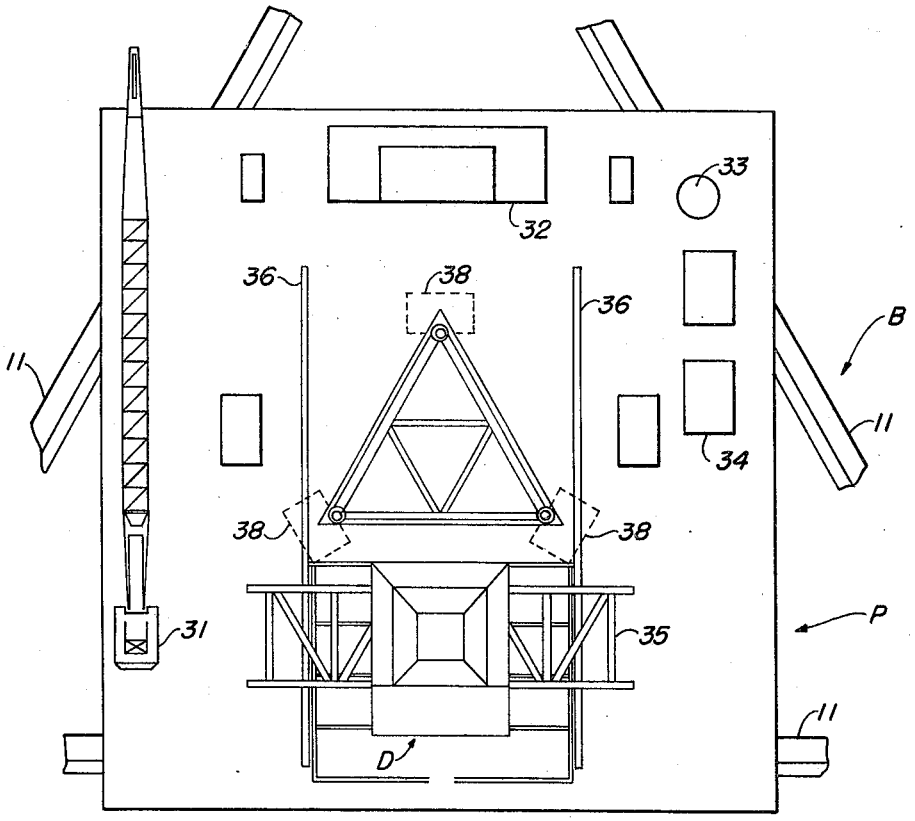
FIG. 5, taken along line 5—5 of FIG. 2, is a partial plan view of a preferred embodiment of the invention illustrating the upper platform and components mounted thereon.

The bottom or base of leg L may be attached, such as by welding to the base B and generally centrally thereof. See also FIG. 6 where platform P is shown by dotted lines to illustrate the relative size of base B and platform P. The leg may comprise vertical tubular chord members 20 connected by horizontal and inclined bracing members 21 and 22 respectively. The chord members are preferably arranged so that the leg is triangular or square in cross section. As best seen in FIGS. 1 and 5, the leg L extends upwardly from the base B through a well 30 generally centrally located in platform P. In fact, the leg L might be said to be reciprocable under certain conditions within the well 30.

Figure 3:
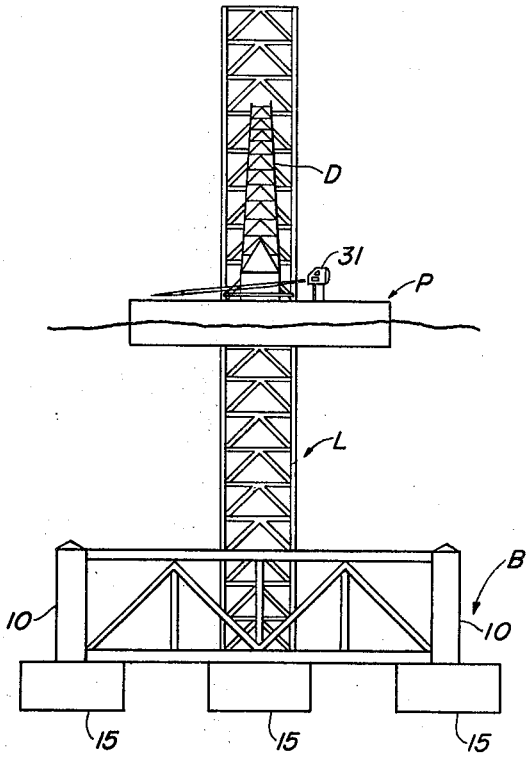

The platform P is of hull type construction and is itself floatable, as shown in FIG. 3, in the water. As best shown in FIG. 5, the platform P supports the drilling derrick D and other necessary equipment such as, cranes 31, control quarters 32, tanks 33, storage compartments 34, etc. So that the derrick D will not interfere with lowering and raising of the leg L and base B, the derrick D may be mounted on a substructural 35 for lateral movement on rails 36 from a first position, as shown in FIG. 5, laterally displaced from the well 30, to a second position in which the derrick is directly over the well 30. Any suitable means of moving the substructure on the rails may be provided.

Figure 6:
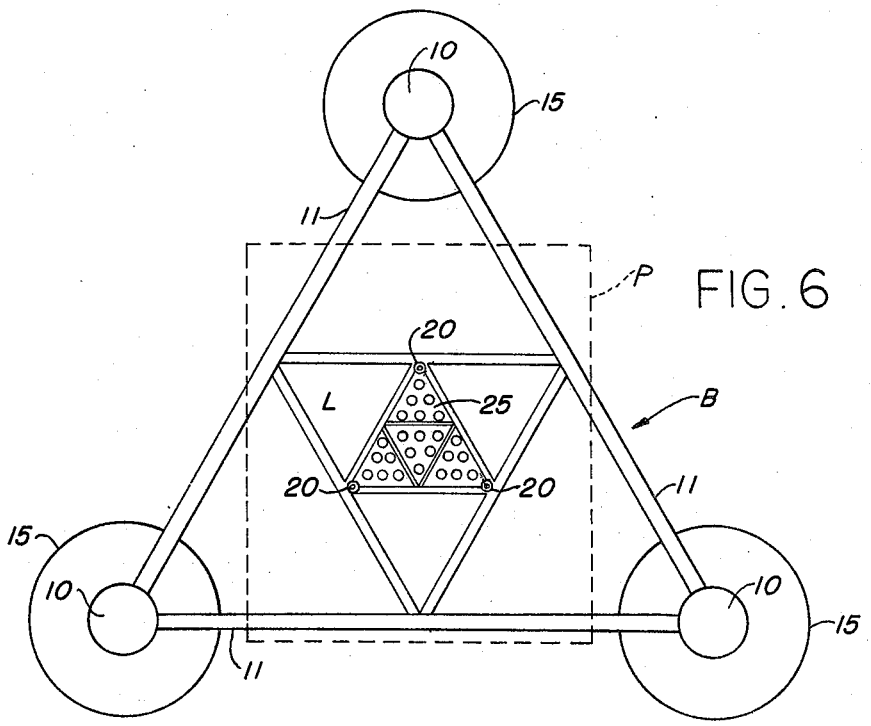
FIG. 6, taken along line 6—6 of FIG. 4, is a horizontal cross-sectional view of the leg and base portion of the drilling unit drawn on a reduced scale.

Drilling templates, such as 25 shown in FIGS. 1 and 6 may be provided at various points along the leg L to guide pipe strings to the floor of the body of water. In addition to lateral movement on the rails 36, the derrick D may be moved, on the substructure 35, perpendicular to the rails 36 so that the derrick can be centrally positioned over any one of the holes in the templates 25. The platform also supports means for elevating platform P on leg L, such as jacks 38. Several suitable types of jacks are known.

STATEMENT OF OPERATION

In the initial or transit position of FIG. 2, enough ballast is removed from the tanks 10 and 15 so that the base B is floating and supporting the remainder of the unit. In this position, the unit may be attached to an ocean going tow vessel for transit to a preselected drilling site. Should heavy seas be encountered during transit, ballast may be introduced into the tanks 10 and 15, at least partially submerging the base B, as shown by dotted lines in FIG. 2. In this position, the center of gravity is lowered and the stability of the unit is increased. When these adverse conditions have subsided, the ballast may be removed and the base B returned to the floating or transit position of FIG. 2 (solid lines).

Once the unit reaches the preselected drilling site, ballast may again be introduced into the tanks 10 and 15 causing the base b to be slowly submerged in the body of water. In the initial stages of this movement, the platform P moves downwardly to assume the floating position of FIG. 3. The relative movement of the leg L is permitted by releasing the elevating jacks 38.

Figure 4:
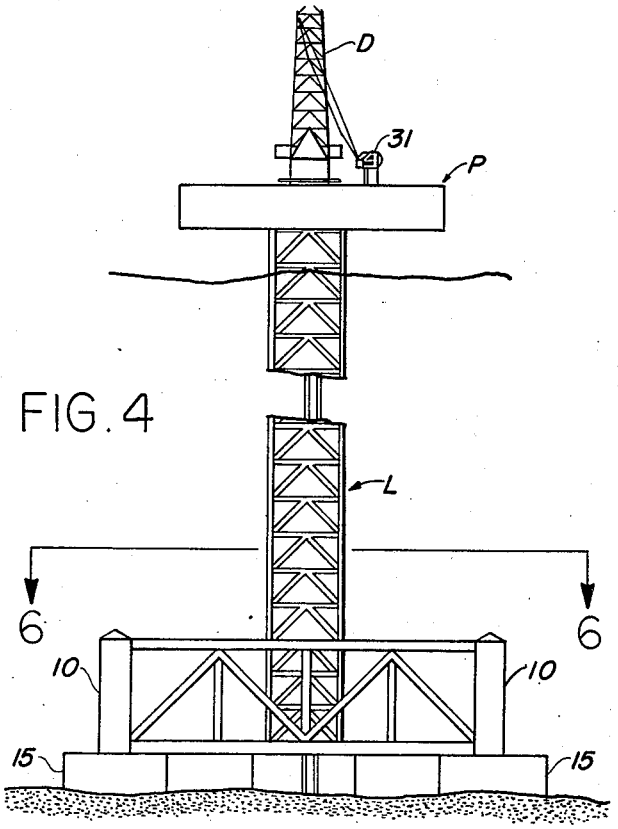

The base B is further submerged until it contacts the floor of the body of water finally supporting the base and the leg L as shown in FIG. 4. Once the base B and leg are fully supported on the floor of the body of water, the elevating mechanisms 38 are activated causing the platfrom P to be elevated above the body of water as shown in FIG. 4. Then the derrick D can be laterally moved from its transit position to a position above a selected hole in the drilling templates. From this position, drilling may commence. As can be readily understood, the derrick may be moved from template hole to template hole so that a plurality of wells can be drilled without disturbing the position of the base B, leg L and platform P. If desired, the elevating mechanisms 38 may be removed after drilling has been completed and the entire unit converted to a permanent or semi-permanent production platform. However, if it is desired to move the unit to a different location, it is only necessary to move the derrick to its non-interfering initial position, lower the platform until it is floating in the water, and raise the base B and leg L by removing ballast from the tanks 10 and 15. Then the unit may be towed to another site.

In addition to providing ballast control, the tanks 10 and 15 may provide large oil or drilling fluid storge capacity under water. This effects considerable ecomomics in the structure since the major weight is near the bottom where comparatively less structure is required for support.

As can be seen from the foregoing description and accompanying drawings the mobile drilling unit of the present invention offers the combined advantages of submersible, semi-submersible and jack-up type drilling rigs. In particular, the drilling rig of the present invention offers a low center of gravity for ocean tow with a high degree of oceam tow stability at much less cost than jack-up drilling rigs designed for comparable water depths. By having a single leg, wave and wind forces are minimized by reducing the amount of structure which is exposed to the wind and waves. The rig of the present invention provides the fixed support and greater in-place stability afforded by submersible bottom resting rigs without the depth limitations thereof. By the unique structural arrangement, the majority of the rig weight is kept to provide maximum stability, in the transit condition and only the minimum weight is elevated in the operating condition, thus making the rig efficient and economical.

Overall, the drilling unit of the present invention is highly flexible. Although only one embodiment has been described herein, many variations of the invention can be made by those skilled in the art without departing from the spirit of the invention. Therefore, it is intended that the scope of the invention be limited only by the claims which follow.

I claim:

1. A mobile drilling unit for use in a body of water comprising: a floatable base; a floatable platform; and a single vertical support leg attached to said base and extending upwardly through a well centrally provided therefor in said platform; said floatable base comprising a plurality of vertical columns surrounding the bottom of said support leg and connected to each other and said support leg by interconnecting structural members to form a substantially horizontal frame, each of said columns being hollow so as to render said base buoyant, means for introducing and removing ballast to and from said columns for positioning said floatable base between a floating position at the surface of said water body and a submerged position on the floor of said body of water, said base, when in said floating position, being of a sufficient buoyancy for supporting both said support leg and said platform thereon; said support leg and platform being provided with elevating means for vertical positioning of said platform on said support leg between a first position in which said platform rests and is supported on said base frame, when said base is in its floating position, and a second position in which said platform is elevated above said body of water, with said base in its submerged position.

2. A mobile drilling unit as set forth in claim 1 in which a cylindrical storage tank is attached to said base at the bottom of each column, each of said tanks being internally free of the structural members of said floatable base frame.

3. A mobile drilling unit as set forth in claim 1 in which said support let is triangular and substantially uniform in cross section throughout its length, comprising three longitudinal chord members connected by interconnecting lateral bracing.

4. A mobile drilling unit as set forth in claim 1 in which said well is generally centrally located in said platform, said platform including a drilling derrick mounted for lateral movement of said platform from a first position not interfering with the movement of said leg through said well to a second position above said well in which drilling can take place through said well and said leg.

5. A portable drilling unit as set forth in claim 4 in which said derrick is mounted on rail means for movement between said first and second positions.

* * * * *